United States Patent [19]

Simon et al.

[11] Patent Number: 4,894,077

[45] Date of Patent: Jan. 16, 1990

[54] METHOD OF ACCUMULATING AND RESTITUTING COLD AND DEVICE FOR IMPLEMENTING SUCH METHOD

[75] Inventors: Laszlo Simon, Satigny; Jean Pfau, Collonge-Bellerive, both of Switzerland

[73] Assignee: Coldeco S.A., Carouge, Switzerland

[21] Appl. No.: 110,691

[22] PCT Filed: Jan. 16, 1987

[86] PCT No.: PCT/CH87/00007

§ 371 Date: Nov. 18, 1987

§ 102(e) Date: Nov. 18, 1987

[87] PCT Pub. No.: WO87/04509

PCT Pub. Date: Jul. 30, 1987

[30] Foreign Application Priority Data

Jan. 18, 1986 [CH] Switzerland ..... 00180/86

[51] Int. Cl.[4] ..... F25D 3/00

[52] U.S. Cl. ..... 62/59; 62/434

[58] Field of Search ..... 62/59, 434

[56] References Cited

U.S. PATENT DOCUMENTS

| | | | |
|---|---|---|---|
| 4,099,557 | 7/1978 | Bricard et al. | 62/59 |
| 4,111,260 | 9/1978 | Bricard et al. | 62/59 |
| 4,254,635 | 3/1981 | Simon et al. | 62/59 |
| 4,294,083 | 10/1981 | King | 62/434 |
| 4,302,944 | 12/1981 | Gainer | 62/434 |
| 4,480,445 | 11/1984 | Goldstein | 62/434 |
| 4,509,344 | 4/1985 | Ludwigsen et al. | 62/434 |
| 4,554,797 | 11/1985 | Goldstein | 62/434 |
| 4,596,120 | 6/1986 | Knodel et al. | 62/434 |
| 4,712,387 | 12/1987 | James et al. | 62/434 |

*Primary Examiner*—Ronald C. Capossela

*Attorney, Agent, or Firm*—Frost & Jacobs

[57] ABSTRACT

Method and apparatus for accumulating and restituting cold, the apparatus comprising a storage vessel containing a heat-exchanging and cold-accumulating liquid mixed with a mass of rigid aggregates of crystals of frozen liquid, the crystals being obtained by freezing the liquid by atomization of a refrigerating fluid contacted directly by the liquid, means to create during the cold accumulation phase a piston composed of a homogeneous, porous and compact mass of rigid aggregates of crystals of the liquid, means to deposit the crystals evenly on top of the piston, and means to resorb the piston from the top.

23 Claims, 3 Drawing Sheets

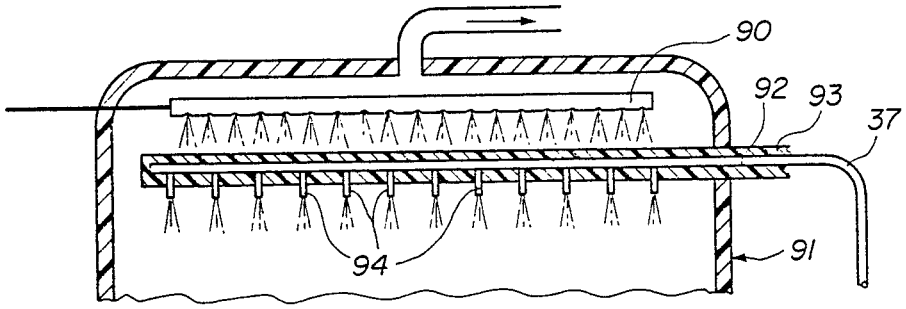
FIG. 4
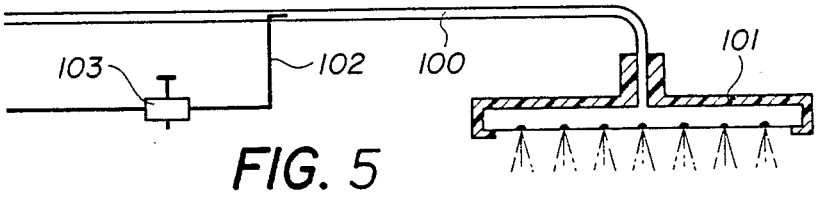
FIG. 5
FIG. 6
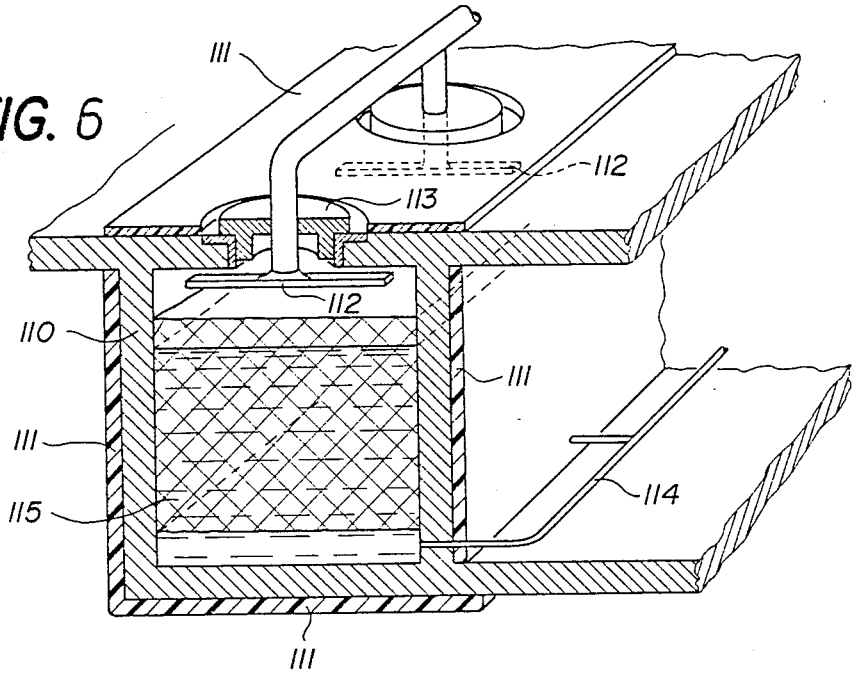

METHOD OF ACCUMULATING AND RESTITUTING COLD AND DEVICE FOR IMPLEMENTING SUCH METHOD

BACKGROUND OF THE INVENTION

The present invention relates to a method of accumulating and restituting cold, wherein, during cold-accumulating phases, in a storage vessel containing a mass of cold-accumulating and cooling liquid, a cluster of rigid aggregates of crystals of this frozen liquid is accumulated, and wherein, during cold-restitution phases, the cold accumulated in the storage vessel is restituted to a utilization circuit by fusion of said crystals in the vessel, by making a stream of said liquid circulate in closed circuit, successively through said cluster and said utilization circuit.

The present invention also relates to a device for implementing this method, including a storage vessel containing a cold-accumulating and cooling liquid, at least partially in the form of a cluster of rigid aggregates of crystals of said frozen liquid, these crystals being obtained by freezing this liquid by vaporizing a refrigerant brought into direct contact with cold-accumulating and cooling liquid, and means for injecting refrigerant at least partially in the liquid state, into this liquid.

The systems operating according to this known method, invented by M. L. Simon and described for example in Swiss patent No. 628,417, have multiple advantages over other known systems for accumulating cold wherein a cold-accumulating liquid, formed in general, as in the SIMON system, of water or an aqueous solution, for example a eutectic or non-eutectic solution of mineral salts such as sodium chloride or calcium chloride, is frozen on the outer surface of a refrigerant-evaporator or a heat exchanger traversed by water with glycol cooled to a temperature below 0° C.

In particular, these new systems are notably more compact, simpler and more economical than other known systems.

Moreover, their thermodynamic efficiency, which constitutes an important quality coefficient, is superior to that of these conventional systems because, with this new process, the vaporization temperature of the refrigerant, which presents a large surface for direct contact with the cold-accumulating and cooling liquid to be frozen, is very close to the freezing temperature of this liquid, while with the other known systems, this vaporization temperature is several degrees Celsius less than said freezing temperature because the exchange of heat between the refrigerant and the cold-accumulating and cooling liquid is effected across the whole thickness of the solid ice deposit, of low thermal conductivity, which covers the above-mentioned evaporator or heat exchanger. This drawback is reduced, but not eliminated in other known systems wherein solid aggregates of macroscopic ice crystals are produced by indirect cooling of the accumulating liquid on the wall surface of a refrigerant evaporator and are mechanically scraped off or carried off by a thin film flowing by gravity over the surface of a cold wall to constitute with cooling liquid a heterogeneous mixture of pasty consistency which is conveyed and then discharged into a cold-storage vessel, as described in U.S. Pat. No. 4,480,455 or in U.S. Pat. No. 4,509,344.

Cold accumulating systems are in general characterized by two other economically significant quality coefficients: their cold-accumulating capacity per unit volume of space utilized by the installations (kcal/m$^3$) on one hand, and their cooling efficiency of the cooling liquid during their cold-restitution phases on the other hand. This cooling efficiency may be defined, for a given flow rate D of the cooling liquid (m$^3$/h), as the ratio: $R(D)=(\theta 1-\theta 2)/\theta 1-\theta o)$ where $\theta 1$ is the temperature of the cooling liquid heated after its passage in the utilization circuit, on its arrival in the accumulator, where $\theta 2$ is the temperature of this liquid after its cooling in the accumulator, at the outlet of the latter, and where $\theta o$ is the freezing temperature of the cooling liquid. This ratio R(D), included between 0 and 1, is independent of the temperature $\theta 1$, but varies with the flow rate D. The product $C.\rho.D.R(D).(\theta 1-\theta o)$ is equal to the power of cold extraction Pe (k.cal/h) of a cooling liquid of specific heat C and specific mass $\rho$. For water $(C\rho)=1000$ kcal/m$^3$.

These two quality coefficients C and R(D) may be greater with the systems operating according to the method described in the above-mentioned Swiss patent than those of the other known cold-accumulation methods, at a lower cost. It is the analysis of the mechanisms responsible for the limitation of these quality coefficients which has led to the present invention.

According to the method described in the above-mentioned Swiss patent, it is customary to produce said crystals, as previously indicated, by the vaporization of a refrigerant in the bulk of said liquid, this vaporization being effected in a crystallization vessel or directly at the bottom of the storage vessel. This vaporization generates microscopic crystals which tend to be aggregated and, if one does not take special precautions, to be concentrated towards the top of the crystallization vessel or the storage vessel by decantation, to form there a slurry of ice crystals and accumulating liquid already having a certain solid or pasty consistency (commonly called "slurry") before said slurry is accumulated in the storage vessel to form said rigid solid cluster of ice commonly called "ice pack". In the other known above-mentioned methods with indirect freezing, for example that described in U.S. Pat. No. 4,480,445 or in U.S. Pat. No. 4,509,344, this slurry, formed of solid crystals of larger size, has a still less fluid consistency.

It is observed that by accumulating in the vessel this slurry containing coarse crystals and having an at least partly solid consistency, by discharging or letting it decant thereon, the ice cluster formed in the vessel has a porous microscopic structure but a heterogeneous and irregular macroscopic structure and a non uniform thickness and height. The bulk of the ice cluster frequently has cavities and an irregular network of communicating free spaces, of variable forms and sizes, which may attain several centimeters. These cavities and these free spaces are generally filled with gaseous refrigerant in the part of the cluster which emerges from the bulk of the cold-accumulating and cooling liquid contained in the vessel, and with this accumulating liquid and/or with gaseous refrigerant in the immersed part of said cluster.

Structural rearrangements accompanied by fissures may also occur in the bulk of the cluster in the course of formation (cold-accumulation) and by resorption of this cluster (cold-restitution) by the effect of mechanical tensions induced by gas pockets or defects of uniformity of the thickness and the height of this cluster, and/or induced by the development of forces of restrainment of said cluster by the walls of the accumulating vessel, or by elements solid with this vessel in the course of formation or resorption of said cluster.

The heterogeneous structure of the bulk of said cluster of ice and cold-accumulating and cooling liquid, and its non uniform thickness, limit the amount of ice which may be stored in a given vessel and, consequently, the cold-accumulating capacity of this vessel.

Moreover, the existence of a few spaces of large size in said cluster leads to the formation of preferential passages through this cluster. In the phases of fusion of this cluster by the reheated liquid, these passages tend to be spontaneously enlarged by fusion of the crystals at their surface, which rapidly induces hydraulic short-circuits through said cluster which, by diverting a considerable part of the cold-accumulating and cooling liquid out of the porous aggregate of the cluster, considerably lowers the effective surface of the contact interface between the liquid and the ice crystals where the exchange of heat takes place.

This results in a serious limitation of the cooling efficiency of the cold-accumulating and cooling liquid traversing said cluster. Moreover, on account of the random nature of the formation of said preferential passages, one sometimes observes fluctuations of the outlet temperature $\theta 2$ of the cooling liquid, hence of the cooling efficiency R(D), in the course of the same cold-restitution phase, or from one such phase to the other, and also variations of the maximum amount of cold which may be accumulated in the storage vessel.

The present invention has as a main object to increase the cold-accumulating capacity and the efficiency R(D) of cooling the cold-accumulating and cooling liquid of the systems operating according to the known new method of cold-accumulation. It also has the object of ensuring perfectly stable and reproducible operation of these systems.

The invention also has the object of enabling the cold-restitution to be effected with a higher flow rate D of cold-accumulating and cooling liquid than with the known systems of same dimensioning, hence to restitute the cold load accumulated in the storage vessel in a sorter period, at high power, while maintaining a high efficiency R(D), that is, by delivering the liquid at a temperature $\theta 2$ close to $\theta o$.

SUMMARY OF THE INVENTION

To this end, the method according to the invention characterized in that, during the cold-accumulation phases, a rigid piston formed of a porous compact cluster of said crystal aggregates, of uniform thickness and height and of homogeneous structure, free from cavities, free spaces and other defects of macroscopic homogeneity of its structure, impregnated with cold-accumulating and cooling liquid, up to the height of a free surface of this mass of liquid, is created by forming said rigid crystal aggregates directly in said vessel on the upper surface of said cluster, by uniformly resorbing this piston from the top, in the course of the cold-restitution phases, by uniformly spraying onto its upper surface with cold-accumulating and cooling liquid, withdrawn at the bottom of the storage vessel and reheated above its freezing temperature after its passage in the utilization circuit, and in that the integrity of the structure of said piston is maintained by letting said piston slide freely, as a whole, during the cold-accumulation and cold-restitution phases, along the vertical wall surfaces of this vessel, downwards during the cold-accumulation phases and upwards during the cold-restitution phases.

According to a first embodiment, said piston is formed by spraying and uniformly dispersing on top of its surface, in the form of a rain or mist, to form thereon said rigid aggregates across a space containing gaseous refrigerant, over the entire horizontal section of said storage vessel, a homogeneous mixture of fluid consistency of cold-accumulating and cooling liquid and microscopic crystals of said frozen liquid.

Said homogeneous mixture of fluid consistency is preferably created by vaporization of a refrigerant injected at least partly in the liquid state into a mass of said liquid contained and maintained in movement within the crystallization vessel.

According to a second embodiment, said piston is formed by uniformly dispersing on top of its surface to form thereon said rigid aggregates across a space containing said refrigerant in the gaseous state, a rain, a wet snow and/or a mist of particles of cold-accumulating and cooling liquid whose partial freezing is effected in said space by vaporizing in said space refrigerant in the liquid state injected and expanded in said space.

According to a first variant of this second embodiment, said piston is formed by creating in said space containing gaseous refrigerant and by uniformly distributing on its surface, to form said rigid aggregates thereon, over the entire horizontal section of said storage vessel, a rain and/or a mist of wet snow, this snow being obtained by partial freezing and projection into said space of cold-accumulating and cooling liquid brought into direct contact in at least one projecting nozzle with refrigerant at least partly in the liquid state expanded in said space.

According to a second variant of the second embodiment, said piston is formed by creating in said space containing gaseous refrigerant and by uniformly distributing on its surface, to form thereon said rigid aggregates, over the entire horizontal section of said storage vessel, a rain and/or a mist of wet snow, this snow being obtained by expanding a mixture of cold-accumulating and cooling liquid and liquid refrigerant injected under pressure into said space. Said mixture is formed of an emulsion of liquid refrigerant dispersed in the cold-accumulating and cooling liquid.

According to a third variant of the second embodiment, said piston is formed by creating in a space containing gaseous refrigerant and by uniformly spreading on its surface, to form thereon said rigid aggregates, over the entire horizontal section of said storage vessel, a rain including particles of liquid refrigerant and particles of cold-accumulating and cooling liquid and of crystals of this liquid, this rain being obtained by spraying and expanding a refrigerant at least partly in the liquid state in this same space, uniformly across the entire section of the vessel.

The three variants of the second embodiment have, with respect to the first embodiment, the important advantage of a substantially lower cost on account of their great simplicity due notably to the absence of a crystallization vessel. Moreover, the concentration of crystals of frozen cold-accumulating and cooling liquid in the particles deposited on the surface of the piston may be much higher than in the first embodiment where this concentration is limited by the necessity of imparting a fluid consistency to the mixture of crystals and cold-accumulating and cooling liquid which must be transported by pumping between the crystallization chamber and the storage vessel. This results in a lower consumption of pumping energy during the cold-accumulation phases and reduced installation costs.

In the course of the cold-restitution phases, in an advantageous embodiment, cooled liquid withdrawn from the bottom of the storage vessel is admixed with the reheated cold-accumulating and cooling liquid coming from the utilization circuit, and the mixture of these liquids is uniformly distributed on the upper face of said piston.

In the course of the cold-restitution phases, in another advantageous embodiment, the cold-accumulating and cooling liquid coming from the utilization circuit is precooled by injecting therein at least partly liquid refrigerant and inducing an at least partial vaporization of this refrigerant fluid in said liquid, without involving freezing thereof, before uniformly distributing this liquid on the upper surface of the piston.

In the course of the cold-restitution phases, according to another advantageous embodiment, a mixture of cooled cold-accumulating and cooling liquid withdrawn at the bottom of the storage vessel with liquid coming from the utilization circuit, precooled by injecting and vaporizing refrigerant in this liquid, is uniformly distributed on the upper surface of the piston.

One may also restitute a part of the cold accumulated in the vessel to said utilization circuit in the course of a cold-accumulation phase in this vessel, by making cold-accumulating and cooling liquid withdrawn at the bottom of the vessel circulate through this utilization circuit and through this piston, while at the same time uniformly dispersing said crystals on the upper surface of the piston.

To reinforce the structure of the piston and increase its crystal concentration, a complementary solidification of the mass of the piston may be advantageously effected by uniformly distributing liquid refrigerant on the upper surface of the piston, by spraying or sprinkling, from the top of the storage vessel containing gaseous refrigerant, in such a manner that this liquid refrigerant penetrates into the upper layers of the porous mass of the piston and, by being vaporized, freezes therein the cold-accumulating and cooling liquid retained by the crystal aggregates constituting this mass situated above said free level of the liquid contained in the storage vessel.

The device for implementing the method defined above is characterized in that it includes means for creating in the course of the cold-accumulating phase, a piston formed of a homogeneous, porous and compact cluster of said rigid crystal aggregates, means for sprinkling and/or spraying for uniformly dispersing from the top of the storage vessel a mixture of said crystals and cold-accumulating and cooling liquid over its entire horizontal section, means for at least partially resorbing said piston, from its upper part, in the course of the cold-restitution phase, means for uniformly distributing in the course of said phase and on its upper surface, cold-accumulating and cooling liquid coming from the utilization circuit reheated during its passage through this circuit, and means for preventing the formation of fissures, free spaces and other defects of macroscopic homogeneity of the structure of said piston, in the course of the phases of accumulation and/or fusion of said crystals, these means permitting the free vertical displacement of the piston, as a whole, in said vessel, in the course of these two phases.

According to a particular embodiment, the device includes separate crystallization and storage vessels, and the sprinkling and/or spraying means for uniformly dispersing said crystals from the top of the vessel over its entire section, said means including at least one distribution element mounted at the top of the storage vessel and supplied with cold-accumulating and cooling liquid containing a gel or a suspension of fluid consistency of crystals of this frozen liquid, by a conduit opening above the free level of the liquid contained in the crystallization vessel.

The device advantageously includes conduits adapted to supply the means for sprinkling and/or spraying the cold-accumulating and cooling liquid with a mixture of said reheated liquid, withdrawn at the outlet of the utilization circuit Ec and said cooled liquid, withdrawn at the bottom of the storage vessel and/or withdrawn at the outlet of a crystallization vessel.

According to another embodiment, the device may include conduits adapted to supply reheated cold-accumulating and cooling liquid, withdrawn at the outlet of the utilization circuit Ec, to means for injecting refrigerant where this liquid is cooled by the vaporization of the refrigerant with which it is brought into contact, before being dispersed on the surface of the piston by the means for sprinkling and/or spraying the cold-accumulating and cooling liquid.

According to another variant of an embodiment of the device according to the invention, the means for uniformly dispersing from the top of said vessel said crystals of frozen cold-accumulating and cooling liquid, may include at least one injector disposed in the space overlying the upper surface of the piston, said injector including means for generating a central jet of refrigerant at least partially in the liquid state surrounded by a coaxial jet of cold-accumulating and cooling liquid, said means being adapted to generate a wet snow of crystals of this frozen liquid.

According to an advantageous embodiment of the device according to the invention, the means for uniformly dispersing said crystals of frozen cold-accumulating and cooling liquid from the top of the vessel, comprise a mixer adapted to admix refrigerant under pressure with this liquid under pressure and at least one expansion pipe for injecting this mixture into said space containing refrigerant in the gaseous state.

According to a particular variant of an embodiment according to the invention, the means for uniformly depositing said crystals of frozen cold-accumulating and cooling liquid from above, may include means for generating a rain including particles of liquid refrigerant and particles of said cold-accumulating and cooling liquid and of crystals of this liquid, said means being disposed in the space overlying the upper surface of the piston and comprising at least one element for uniformly spraying cold-accumulating and cooling liquid in said space, to form a rain and/or a mist of fine droplets of this liquid, and at least one injector element for injecting refrigerant at least partially in the liquid state into this atmosphere.

The inner lateral wall surfaces of the storage vessel are preferably coated with a layer of a material which is antiadherent for crystals of frozen cold-accumulating and cooling liquid.

According to another advantageous embodiment, the distribution element connected to the conduit for supplying cold-accumulating and cooling liquid cooled in the crystallization vessel or a mixture of this cooled liquid with liquid reheated in the utilization circuit Ec, is also connected, by a bypass to the return conduit, to enable selectively supplying said distribution element either with cold-accumulating and cooling liquid reheated in the utilization circuit, or with liquid cooled in the crystallization vessel, or with a mixture of this cooled liquid with liquid reheated in the utilization circuit Ec, or with a suspension or a gel of fluid consistency formed of a mixture of cooled liquid and crystals of this liquid in the frozen state generated in the crystallization vessel.

BRIEF DESCRIPTION OF THE DRAWINGS

The present invention will be better understood with reference to the description of examples of embodiments and the accompanying drawings, wherein:

FIG. 4 represents means for generating a fine snow of frozen cold-accumulating and cooling liquid, FIG. 5 represents other means for generating a wet snow of frozen cold-accumulating and cooling liquid, and FIG. 6 represents a particular embodiment of the vessels of the device according to the invention.

DETAILED DESCRIPTION OF THE INVENTION

Figure 1:
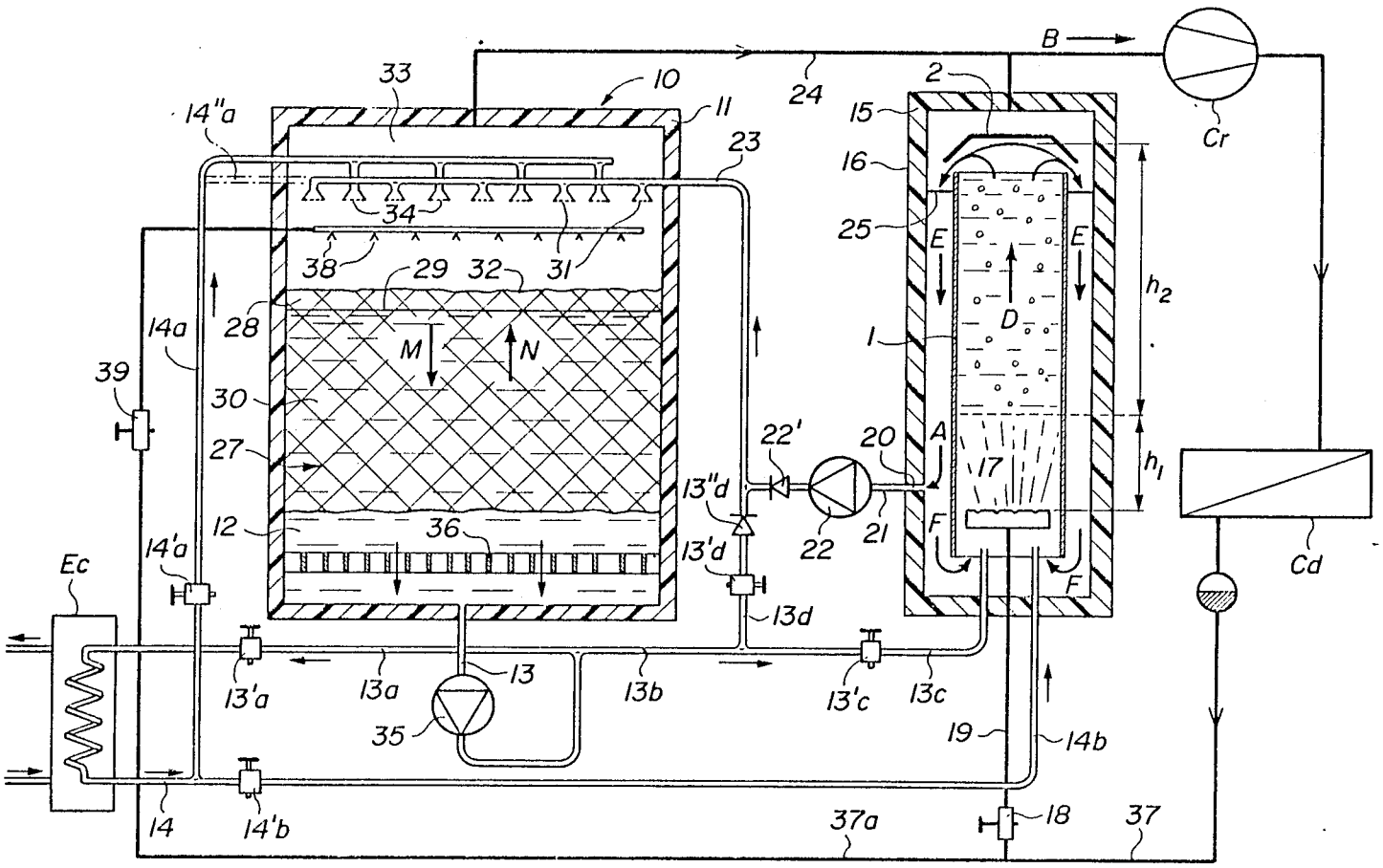
FIG. 1 represents a schematic view of a first embodiment of the device according to the invention.

FIG. 1 illustrates a first embodiment of the device for generating, accumulating and storing cold which essentially includes a storage vessel 10, surrounded by a thermal insulation sheath 11 and containing a freezable cold-accumulating liquid 12, for example water, which also serves as a coolant liquid in a utilization circuit Ec (partially represented), comprising at least one heat exchanger, and including an outlet conduit 13 for cold-accumulating and cooling liquid and a return conduit 14 for this reheated liquid. This device moreover includes a crystallization vessel 15, also surrounded by a thermal insulation sheath 16, and containing the same freezable cold-accumulating and cooling liquid 12. The crystallization vessel is intended to produce a suspension or a gel of liquid consistency, of crystals of the freezable liquid 12 by direct injection, into this liquid, of a refrigerant injected at least partially in the liquid state, by an injector 17 connected to a pressure reducing valve 18 via a conduit 19, and disposed substantially at the base of the crystallizing cell 15.

In a manner known per se, described in the three patent applications of the applicant filed simultaneously with the present application, the refrigerant is vaporized at a height h1 above the injector 17 and at a distance h2 below the free surface of the column of cold-accumulating and cooling liquid contained in the tubular element 1. The vaporization of the refrigerant creates by siphon effect a rapid stream of cold-accumulating and cooling liquid 12 in closed circuit in the vessel 15, and generates in the bulk of this liquid microscopic crystals of this frozen liquid which, due to this rapid stream, form with this liquid a gel or a suspension of fluid consistency which is propelled as shown by the arrow A through the mouth 20 of a conduit 21, by a pump 22 and a non return valve 22' whose outlet is connected to a distribution conduit 23 terminating at the top of the storage vessel 10.

A conduit 24 is connected to the top of the storage cell 10 and the crystallization vessel 15, and balances the pressures of the gaseous refrigerant in these vessels. The gaseous refrigerant recovered at the top of the vessels 10 and 15 is aspirated in the direction of the arrow B by a compressor Cr and then liquefied in a condenser Cd.

The storage vessel 10 has the form of a vertical cylinder, of cylindrical section or not, closed at both extremities and whose inner lateral wall surfaces are advantageously provided with a layer of a material which is antiadherent to crystals, for example a lacquer of synthetic resin with a smooth surface, intended to facilitate the displacement of a piston 27 formed by the deposition and by the aggregation of the microscopic crystals in suspension in the cold-accumulating and cooling liquid 12, generated in the crystallization vessel 15. This piston is composed of an upper layer 28 of aggregates of crystals which are dry or slightly impregnated with liquid 12, disposed above the free level 29 of this liquid in the storage vessel, and a porous, compact cluster 30 of crystal aggregates impregnated with liquid 12, disposed below said free level 29.

This piston results from the uniform deposition, extending over the entire horizontal section of the cell, of the microscopic crystals contained in the homogeneous mixture of fluid consistency of these crystals with the cold-accumulating and cooling liquid and in suspension in this liquid, by means of distributors 31, for example sprinkling and/or spraying heads. Given that the piston 27 is a porous mass, the crystals contained in this suspension are retained and form rigid aggregates directly at the upper surface 32 of the mass 28, and the liquid is drained through this mass 28, to the free level 29.

During the accumulation phase, the crystallization vessel produces the gel or the suspension of fluid consistency, whose concentration of crystals advantageously lies between 0.1 and 2% and below 25%, which is injected through the distributors 31 into the space 22, overlying the upper surface of the piston 27, in the form of a rain or mist. As these crystals poured out by the distributors 31 accumulate at the upper surface 32 of the mass 28, the entire piston 27 tends to sink progressively as a whole into the liquid 12 contained in the storage vessel 10. Thanks to the smooth inner coating and to the substantially vertical walls of the storage vessel, the piston 27 may be freely displaced as a whole towards the bottom of the cell in the direction of the arrow M, during the cold-accumulation phase, this displacement as a whole making it possible to maintain the integrity of the structure of the piston by notably avoiding the formation of fissures or other free spaces in the bulk of the piston.

In the phase of restitution of the cold accumulated in the storage vessel, the piston 27 which is resorbed bit by bit, will tend to be displaced vertically upwards in the direction of the arrow N. As in the accumulation phase, the displacement of the piston is effected as a whole to avoid the formation of fissures, breaks, etc., thanks to the cylindrical form of the vessel walls, and thanks to the antiadherent coating, if necessary, of the inner surface of these walls.

During this phase, the fusion of the crystals may create inhomogeneities in the upper zone of the piston. The lower mass constitutes a true filter retaining the crystals possibly detached in the course of this fusion, so that the piston remains constituted and is displaced as a whole.

During the formation of the piston, it is imperative to distribute the gel or the suspension charged with crystals of frozen cold-accumulating and cooling liquid, in a uniform manner to avoid any formation of hollows or cavities liable to subsequently favor the formation of preferential passages through the piston and to ensure a uniform thickness and height of the piston. In the course of the restitution phase, it is also advantageous to distribute the reheated fluid uniformly, for example in the form of a fine rain, over the whole upper surface of the piston 27 in such a manner that the fusion is effected from the top of the piston, so that the reheated liquid is constrained to traverse the porous mass of the piston 27 before being reinjected once more into the utilization circuit Ec.

According to an advantageous embodiment, the return conduit 14 of the utilization circuit comprises a first conduit 14*a* opening at the top of the storage vessel 10 and provided with a series of distributors 34, for example in the form of sprinkling and/or spray heads, designed to uniformly distribute the reheated liquid, coming from the heat exchanger Ec, over the upper surface 32 of the piston 27, and a second conduit 14*b* opening at the bottom of the crystallization vessel. The conduit 14*a* is provided with a valve 14'*a* and the conduit 14*b* is equipped with a valve 14'*b*, which enable to independently divert the totality of the reheated liquid to one or the other of these conduits, or to separate the return flow selectively between these conduits. These valves, known per se, are either manual, or electrically controlled.

A bypass conduit 14''*a* may be connected to the conduit 23 carrying the distribution element 31. This distribution element 31 is thereby fed selectively either with the mixture of fluid consistency of crystals and liquid, or with the reheated liquid coming from the utilization circuit Ec.

The outlet conduit 13 to the utilization circuit, provided at the bottom of the storage vessel 10 is connected to the inlet of a pump 35 whose outlet is divided, into two conduits 13*a* and 13*b*. The conduit 13*a* equipped with a valve 13'*a* defines the actual inlet of the utilization circuit. The conduit 13*b* is divided into two branches 13*c* and 13*d* of which the first, 13*c*, equipped with a valve 13'*c*, opens at the bottom of the crystallization vessel 14, with a view to injecting therein liquid to be frozen, if necessary, and of which the second, 13*d*, equipped with a valve 13'*d* and with a non return valve 13''*d*, is connected to the distribution conduit 23 previously defined. These different conduits make it possible to selectively divert the cooled liquid drawn off from the bottom of the storage vessel 10 to the utilization circuit, the lower zone of the crystallization vessel 15 and/or the upper zone of the storage vessel 10.

To avoid accidental obturation of the conduit 13 at the end of cold-accumulation, the storage vessel 10 advantageously includes a grid 36 provided below the piston 27.

The refrigerant circuit comprises the previously mentioned conduit 24 connected to the compressor Cr, itself connected to the condenser Cd whose outlet defined by the arrow C is connected to a distribution conduit 37 which feeds the injector or injectors 17 through the adjustable expansion valve 18 and also an array of atomizers 38 through a control valve 39 which enables to adjust, as required, the refrigerant flow rate, to inject or to cut off this feed. This array of atomizers enables to spray or sprinkle liquid refrigerant onto the upper surface of the piston 27, with a view to a complementary solidification of the mass of crystals in the upper zone of this piston.

A tubular element 1 is mounted within the crystallization vessel 15 and this element is surmounted by a deflector 2. This tubular element forms a central chimney which enables to channel the ascending stream, represented by the arrow D, of cooled liquid, charged with microscopic crystals in suspension of this frozen liquid, and also the descending stream, represented by the arrows E. The ascending stream D is generated by siphon effect by the vaporization of the refrigerant in the upper zone of height h2 where vapor bubbles of this refrigerant fluid are formed. A slight part A of this stream is aspirated by the pump 22 and the greater part, represented by the arrows F, is recycled within the tubular element 1. The deflector 2 on one hand, and the fact of having the mouth 20 in the median or lower zone of the crystallization vessel 15 make it possible to ensure maximum degassing of the liquid, that is, an effective separation of the gaseous refrigerant from the liquid.

The fact of admixing with the gel or the fluid suspension leaving the pump 22, liquid coming from the conduit 13*d* enables, during the accumulation phases, to determine the concentration of crystals in the suspension injected by the distributors 31 in the accumulation phase.

The device described above may function according to several distinct modes:

1. Accumulation of cold without restitution:

The pumps 35 and 22 are switched on and also the compressor Cr. The valves 13'*a* and 13'*d* are closed and also the valves 14'*a* and 14'*b*. The valve 13'*c* is open. The liquid withdrawn at the bottom of the vessel 10 circulates through the crystallization vessel.

2. Accumulation of cold with restitution of cold at reduced power:

All components above remain in the same state as before except the valve 13'*a* which is partly open and valve 14'*a* which is completely open. One continues to deposit crystals of which a part is melted with a view to restituting cold at reduced power due to the partial opening of the valve 13'*a*. A variant consists in closing the valve 14'*a* and opening the valve 14'*b*. In this case, the hot liquid injected into the crystallization vessel 15 reduces the quantity of crystals generated in the latter and deposited on the piston.

3. Restitution of cold without accumulation of cold:

The pump 35 is switched on, the pump 22 and the compressor Cr are switched off. The valves 13'*c*, 13'*d* and 14'*d* are closed. The valves 13'*a* and 14'*a* are open. The hot liquid coming from the heat exchanger is poured out by the distributors 34.

4. Restitution of cold without restitution, but with complementary production of cold:

The pumps 35 and 22 are switched on as also the compressor Cr. The valves 13'*c*, 13'*d* and 14'*a* are closed. The valves 13'*a* and 14'*b* are open. In this case, the cell 15 serves to cool the liquid reheated in the heat exchanger, without producing crystals. This mode of operation is advantageous because on one hand, the production of cold during the restitution phase is achieved with a higher thermodynamic efficiency than during the accumulation phase because the vaporization is effected at a higher temperature, and on the other hand, it enables to reduce the dimensioning of the accumulation vessel 10 for a maximum total amount of cold absorbed by the utilization circuit during a restitution phase. This reduction is appreciable when the power of cold restitution Pr is of the order of double the power of cold production Pp in the crystallization vessel 15.

5. Restitution of cold with complementary cold production and precooling of the liquid: All of the components are in the same state as in case 4 except the valve **13'*d* which is open. As a result, by admixing liquid coming from the pump 22 with cold liquid withdrawn at the base of the vessel 10, the temperature of the fluid distributed by the distributors 31 is lowered which, during the cold-restitution phases, improves the cooling efficiency R(D) of the liquid by lowering the temperature 02** of this liquid conveyed to the heat exchanger of the cold-utilization circuit.

Figure 2:
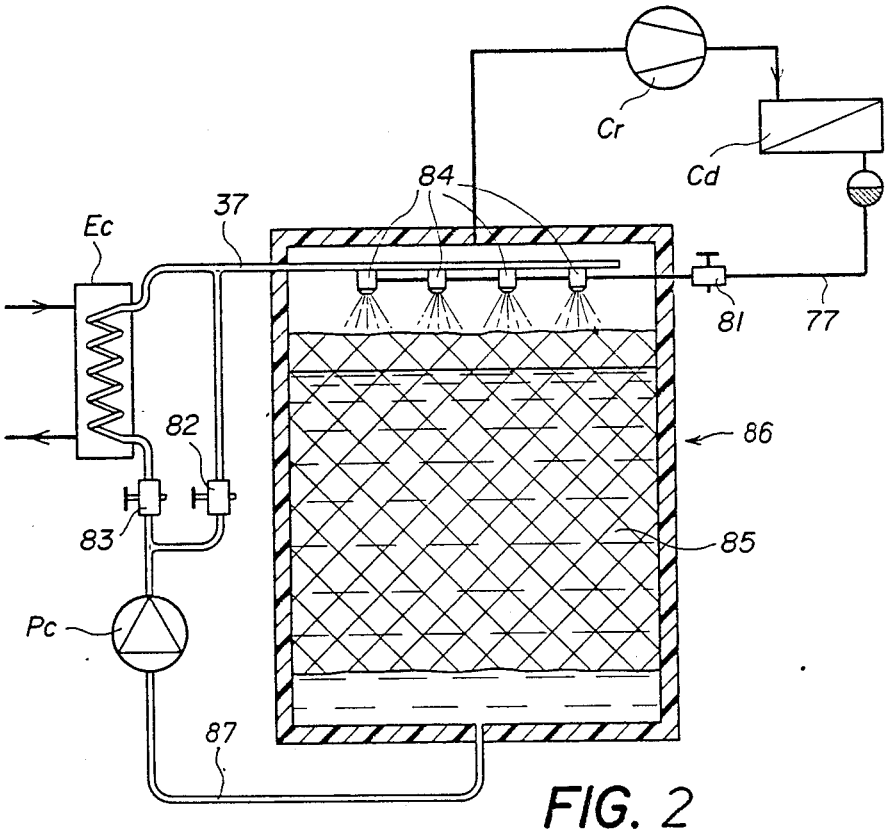
FIG. 2 represents a schematic view of a second embodiment of the device according to the invention.
Figure 3:
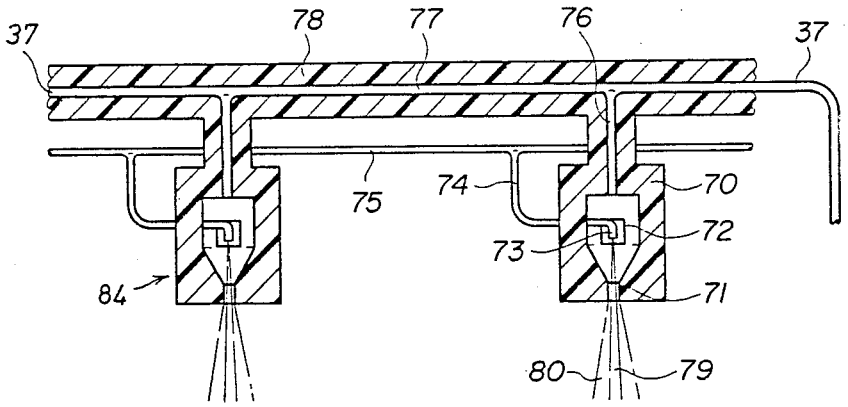
FIG. 3 represents means enabling notably to generate a wet snow formed of crystals of frozen cold-accumulating and cooling liquid.

FIGS. 2 and 3 illustrate means other than a crystallization vessel permitting generation of crystals of frozen cold-accumulating and cooling liquid and uniformly distributing them at the surface of the piston formed within the storage vessel 86 to form rigid aggregates therein. Said means comprise at least one, but preferably several nozzles 84 each formed of a body 70 provided with an opening 71 directed towards said piston and comprising a chamber 72 communicating with said opening. This chamber contains an injector 73 connected by a conduit 74 to a distribution conduit 75 for refrigerant under pressure. The chamber 72 is moreover connected via a conduit 76 to a distribution conduit 77 for cold-accumulating and cooling liquid under pressure, this conduit being thermally insulated by a sheath 78. The injector 73 generates a relatively fine jet 79 of refrigerant at least partially in the liquid state. This jet is directed towards the opening 71 and is surrounded by a coaxial jet of cold-accumulating and cooling liquid. This liquid feeds the chamber 72 at a temperature sufficient to avoid icing of the injector 73. At the outlet of the opening 71, the refrigerant is evaporated and induces freezing of the cold-accumulating and cooling liquid in the form of a wet snow which is spread uniformly at the surface of the piston.

The atmosphere overlying the piston is formed of refrigerant in the gaseous state, and is collected by an appropriate discharge conduit, mounted at the upper extremity of the storage vessel and connected for example to the intake of a compressor Cr.

With reference to FIG. 2, by controlling the opening and closing of the valves 81, 82 and 83 respectively mounted on the refrigerant circuit and that of the cold-accumulating and cooling liquid, one may obtain the following modes of operation:

1. Accumulation of cold by generation of snow without restitution of cold when the valve 83 is closed and the valves 81 and 82 are completely open and when the compressor Cr and the pump Pc are switched on.

2. Accumulation of cold with restitution of cold to the utilization circuit with reduced power when the valves 81 and 82 are open as before, and the valve 83 mounted on the conduit 87 partly open and when the compressor Cr and the pump Pc are switched on.

3. Restitution of cold without accumulation, without precooling of the cold-accumulating and cooling liquid and without auxiliary cold production, when the valves 81 and 82 are closed, and when the compressor Cr is switched off and the pump Pc is switched on. The liquid is heated in the utilization circuit and sprayed by the nozzles 84 in the form of a rain of liquid uniformly distributed on the upper surface of the piston 85.

4. Restitution without accumulation with auxiliary production of cold when the valve 81 is open, the valve 82 closed and the valve 83 fully open, the compressor Cr and the pump Pc being switched on. The flow rate of hot liquid coming from the utilization circuit is then sufficiently high to prevent its partial freezing by the liquid refrigerant which it vaporizes in the nozzles 84, while being cooled, before sprinkling the upper surface of the piston 85 with a fine rain.

5. Accumulation of cold without restitution with complementary solidification of the piston, when the valve 83 is closed, the valve 82 is partly open and the valve 81 is open, the compressor Cr and the pump Pc being switched on. The respective flow rates of the refrigerant and the cold-accumulating and cooling liquid are then such that an excess of liquid refrigerant in particle form accompanies the wet snow produced by the nozzles 84 and sprinkles the upper surface of the piston 85 at the same time as the rain of snow sprinkling it. One thus produces a supplementary solidification of the upper layers of the piston 85 as indicated with reference to FIG. 1.

6. Restitution of cold without complementary cold production with precooling of the cold-accumulating and cooling liquid. The valve 81 is closed and the valves 82 and 83 are open. The compressor Cr is switched off, and the pump Pc is switched on. Cold liquid transmitted by the valve 82 is mixed with hot liquid coming from the utilization circuit Ec, which precools the latter before it is sprayed and its passage through the piston 85 and lowers, as previously explained with reference to FIG. 1, the temperature 02 of the liquid sent to the heat exchanger.

A variant of this embodiment is represented in FIG. 4. A refrigerant-injector 90 generates by vaporization of this refrigerant fluid at the top of the storage vessel 91, above the piston of crystals of frozen cold-accumulating and cooling liquid (not shown), a cold gaseous atmosphere into which cold-accumulating and cooling liquid is injected, supplied by a conduit 92 thermally insulated by an insulating sheath 93 and sprayed through a series of atomizers 94.

Said means enable to generate a fine snow, composed of a mixture of crystals of said frozen liquid and of fine droplets of this liquid and of liquid refrigerant, which is deposited on the upper surface of the piston upon which these crystals directly form said rigid aggregates.

Other means for generating wet snow are illustrated in FIG. 5. A feed conduit 100 for reheated cold-accumulating and cooling liquid withdrawn at the outlet of the utilization circuit, is connected to a distributor-atomizer 101 represented schematically and disposed at the top of a storage vessel (not shown). A conduit 102 enables to inject refrigerant at least partially in the liquid state coming from an expansion valve 103, into the conduit 100 to enable spraying a mixture of cold-accumulating and cooling liquid and refrigerant in the liquid state by the distributor-atomizer 101.

The conduits 100 and 102 may be advantageously adapted for said mixture to be produced in the form of an emulsion of microscopic particles of liquid refrigerant dispersed in the cold-accumulating and cooling liquid. The formation of this emulsion may be facilitated by the addition of an emulsifying agent in slight concentration to this liquid. This emulsion has the object of facilitating the vaporization of the refrigerant into the space filled with gaseous refrigerant and to thereby raise the thermodynamic efficiency of the installation.

To avoid the risks of icing of the orifices of the distributor-atomizer 101, it may be advantageous to inject a sheath of pure cold-accumulating and cooling liquid coaxially surrounding each of the jets of the mixture injected and expanded in the above-mentioned space, in order to thermally insulate them from the wall surfaces of the orifices, as is also the case with the nozzles 70 described with reference to FIG. 4.

The modes of operation of these three variants are the same as those of the installation illustrated in FIG. 2.

FIG. 6 illustrates an embodiment of the storage vessels illustrated in all of the variants previously described. They are formed of at least one enclosure 110 of masonry or the like, for example of reinforced concrete, of parallelepipedic form. This enclosure 110 is preferably disposed underground or buried and thermally insulated on the outer wall surfaces by panels 111. The necessary tightness of the enclosure is achieved by the inner covering of the wall surfaces by means of a synthetic material. The distributing elements 112, carried by a bell 113 which also permits access to the interior of the enclosure, ensuring uniform spraying and/or sprinkling of the upper surface of the piston 115, as previously indicated with reference to FIGS. 1 to 5, with reheated liquid coming from a utilization circuit and/or mixtures of fluid consistency of crystals of this liquid and this liquid generated by vaporization of the refrigerant. These elements 112 comprise tubes for evacuating gaseous refrigerant evolved in the accumulation vessel 110. This system has the advantage of avoiding costly transportation and the fabrication of tight metallic enclosures in situ. Thanks to the parallelepipedic form of the piston, one obtains a maximum accumulating capacity per unit space used.

The present invention is not limited to the described embodiments but may undergo different embodiments and may have different variants obvious to one skilled in the art.

We claim:

1. In a method of accumulating and restituting cold, wherein, during cold-accumulating phases, in a storage vessel containing a mass of cold-accumulating and cooling liquid, a cluster of rigid aggregates of crystals of said liquid is accumulated in a frozen state, and wherein, during cold-restitution phases, the cold accumulated in said storage vessel is restituted to a utilization circuit comprising at least one heat exchanger by fusion of said crystals in said vessel, by circulating a stream of said liquid in a closed circuit successively through said cluster and said utilization circuit, the improvement wherein during the cold-accumulation phases, a rigid piston is created formed of a porous compact cluster of said crystal aggregates, of uniform thickness and height and of homogeneous structure, free from cavities, free spaces and other defects of macroscopic homogeneity of its structure, said piston being impregnated with cold-accumulating and cooling liquid, up to the height of a free surface of said mass of liquid, said piston being created by forming said rigid crystal aggregated directly in said vessel on the upper surface of said cluster and by uniformly resorbing said piston from the top, in the course of said cold-restitution phases, by uniformly spraying an upper surface thereof with cold-accumulating and cooling liquid which is withdrawn at the bottom of said storage vessel and reheated above its freezing temperature after passage thereof in the utilization circuit, and wherein said piston is permitted to slide freely, as a whole, along the vertical wall surfaces of said storage vessel, downwardly during the cold-accumulation phases and upwardly during the cold-restitution phases whereby to maintain the integrity of the structure of said piston.

2. Method according to claim 1, wherein said piston is formed by spraying and uniformly dispersing on top of its surface, in the form of a rain or mist, to form thereon said rigid aggregates across a space containing gaseous refrigerant, over the entire horizontal section of said storage vessel, a homogeneous mixture of fluid consistency of cold-accumulating and cooling liquid and macroscopic crystals of said frozen liquid.

3. Method according to claim 2, wherein said piston is formed by uniformly dispersing on top of its surface to form thereon said rigid aggregates across a space containing said refrigerant in the gaseous state, a rain, a wet snow and/or a mist of particles of cold-accumulating and cooling liquid whose partial freezing is effected in said space by vaporizing in said space refrigerant in the liquid state injected and expanded in said space.

4. Method according to claim 3, wherein said piston is formed by creating in the space containing gaseous refrigerant and by uniformly distributing on its surface, to form said rigid aggregates thereon, over the entire horizontal section of said storage vessel, a rain and or a mist of wet snow, said snow being obtained by partial freezing and projection into said space of cold-accumulating and cooling liquid brought into direct contact in at least one nozzle for projecting refrigerant at least partially in the liquid state, expanded in said space.

5. Method according to claim 3, wherein said piston is formed by creating in said space containing gaseous refrigerant and by uniformly distributing on its surface, to form thereon said rigid aggregates, a rain and/or a mist of wet snow, said snow being obtained by expanding a mixture of cold-accumulating and cooling liquid and liquid refrigerant injected under pressure into said space.

6. Method according to claim 5, wherein said mixture is formed of an emulsion of liquid refrigerant dispersed in the cold-accumulating and cooling liquid.

7. Method according to claim 3, wherein said piston is formed by creating in a space containing gaseous refrigerant and by uniformly spreading on the surface thereof, to form thereon said rigid aggregates, over the entire horizontal section of said storage vessel, a rain including particles of liquid refrigerant and particles of cold-accumulating and cooling liquid and of crystals of said liquid, said rain being obtained by spraying and expanding a refrigerant at least partially in the liquid state in said space, uniformly across the entire section of said vessel.

8. Method according to claim 1, wherein said homogeneous mixture of fluid consistency is created by vaporization of a refrigerant injected at least partially in the liquid state into a mass of said liquid contained and maintained in movement within a crystallizing vessel.

9. Method according to claim 1, wherein in the course of said cold-restitution phases, cooled liquid withdrawn from the bottom of said storage vessel is admixed with said reheated cold-accumulating and cooling liquid coming from said utilization circuit, and wherein the mixture of said liquids is evenly distributed on said upper surface of said piston.

10. Method according to claim 9, wherein in the course of said cold-restitution phases, a mixture of cooled cold-accumulating and cooling liquid withdrawn at the bottom of said storage vessel with liquid coming from said utilization circuit, precooled by injecting and vaporizing refrigerant in said cold-accumulating liquid, is uniformly distributed on said upper surface of said piston.

11. Method according to claim 1, wherein in the course of said cold-restitution phases, cold-accumulating and cooling liquid coming from said utilization circuit is precooled by injecting therein at least partially liquid refrigerant and by inducing an at least partial vaporization of refrigerant fluid in said cold-accumulating liquid, without involving freezing thereof, before uniformly distributing said liquid on said upper surface of said piston.

12. Method according to claim 11, wherein, in the course of said cold-restitution phases, a mixture of cooled cold-accumulating and cooling liquid withdrawn at the bottom of said storage vessel with liquid coming from said utilization circuit, precooled by injecting and vaporizing refrigerant in said cold-accumulating liquid, is uniformly distributed on said upper surface of said piston.

13. Method according to claim 1, wherein a part of the cold accumulated in the vessel is restituted to said utilization circuit in the course of a cold-accumulating phase in said vessel, by making cold-accumulating and cooling liquid withdrawn at the bottom of said vessel circulate through said utilization circuit and through said piston, while at the same time uniformly dispersing said crystals on said upper surface of said piston.

14. Method according to claim 1, wherein a complementary solidification of the mass of the piston is effected by uniformly distributing liquid refrigerant on said upper surface of said piston, by spraying or sprinkling, from the top of said storage vessel containing gaseous refrigerant, in such a manner that said liquid refrigerant penetrates into the upper layers of said porous cluster of said piston and, by being vaporized, freezes therein the cold-accumulating and cooling liquid retained by said crystal aggregates constituting said cluster situated above said free level of said liquid contained in said storage vessel.

15. Device for accumulating and restituting cold, including a storage vessel containing a mass of cold-accumulating and cooling liquid, at least partially in the form of a cluster of rigid aggregates of crystals of said frozen liquid, said crystals being obtained by freezing said liquid by vaporizing a refrigerant brought into direct contact with said liquid, injecting means for injecting refrigerant at least partially in the liquid state into said cold-accumulating and cooling liquid, means for creating in the course of a cold-accumulating phase a piston formed of a homogeneous, porous and compact cluster of said rigid crystal aggregates, means for sprinkling and/or spraying for uniformly dispersing from the top of said storage vessel a mixture of said crystals and cold-accumulating and cooling liquid over the entire horizontal section thereof, means for at least partially resorbing said piston from its upper part, in the course of a cold-restitution phase, means for uniformly distributing in the course of said phase and on an upper surface of said piston, liquid coming from a utilization circuit comprising at least one heat exchanger, reheated during its passage through said circuit, and means for preventing the formation of fissures, free spaces and other defects of macroscopic homogeneity of the structure of said piston, in the course of the phases of accumulation and/or fusion of said crystals, said means enabling free vertical displacement of said piston, as a whole, in said vessel, in the course of said two phases.

16. Device according to claim 15, including separate crystallization and storage vessels, wherein said means for sprinkling and/or spraying for uniformly dispersing said crystals from the top of said vessel over said entire section include at least one distributing element mounted at the top of the storage vessel and supplied with cold-accumulating and cooling liquid containing a gel or a suspension of fluid consistency of crystals of this frozen liquid, and a conduit opening above the free level of said liquid contained in said crystallization vessel.

17. Device according to claim 16, wherein the inner lateral wall surfaces of the storage vessel are coated with a layer of a material which is antiadherent to crystals of frozen cold-accumulating and cooling liquid.

18. Device according to claim 16, wherein said distributing element connected to said feed conduit for supplying cooled cold-accumulating and cooling liquid to said crystallization vessel or a mixture of said cooled liquid with liquid reheated in said utilization circuit, is also connected, by a bypass conduit to a return conduit, to enable selectively supplying said distributing element either with cold-accumulating and cooling liquid cooled in said crystallization vessel, or with a mixture of cooled liquid with liquid reheated in said utilization circuit, or with a suspension or a gel of fluid consistency formed of a mixture of cooled cold-accumulating and cooling liquid and of crystals of said liquid in the frozen state generated in said crystallization vessel.

19. Device according to claim 15, including conduits adapted to supply said means for sprinkling and/or spraying the cold-accumulating and cooling liquid with a mixture of said reheated liquid, withdrawn at the outlet of a utilization circuit and with said cooled liquid, withdrawn at the bottom of said storage vessel and/or withdrawn at the outlet of a separate crystallization vessel.

20. Device according to claim 15, including conduits adapted to supply reheated cold-accumulating and cooling liquid, withdrawn at the outlet of a utilization circuit, to said means for injecting refrigerant, where said liquid is cooled by the vaporization of refrigerant with which it is brought into contact, before being dispersed on said upper surface of said piston by said means for sprinkling and/or spraying said liquid.

21. Device according to claim 15, wherein said means for uniformly dispersing said crystals of frozen cold-accumulating and cooling liquid from the top of said vessel include at least one injector disposed in the space overlying said upper surface of said piston, said injector including means for generating a central jet of refrigerant at least partially in the liquid state surrounded by a coaxial jet of cold-accumulating and cooling liquid, said means being adapted to generate a wet snow of crystals of said frozen liquid.

22. Device according to claim 15, wherein said means for uniformly dispersing said crystals of frozen cold-accumulating and cooling liquid from the top of said vessel include a mixer adapted to admix refrigerant under pressure with said liquid under pressure and at least one expansion pipe for injecting the mixture into said space containing refrigerant in the gaseous state.

23. Device according to claim 15, wherein said means for uniformly dispersing crystals of frozen cold-accumulating and cooling liquid from the top include means for generating a rain including particles of liquid refrigerant and particles of said liquid and of crystals of said liquid, said means being disposed in said space overlying said upper surface of said piston and comprising at least one element for uniformly spraying cold-accumulating and cooling liquid in said space, to form a rain and/or a mist of fine droplets of said liquid, and at least one injector element for injecting refrigerant at least partially in the liquid state into said rain and/or mist.

* * * * *